US007082999B2

(12) United States Patent
Arnot

(10) Patent No.: US 7,082,999 B2
(45) **Date of Patent: *Aug. 1, 2006**

(54) PRESSURIZATION SYSTEM FOR FIRE EXTINGUISHERS

(75) Inventor: Nicholas R. Arnot, Woodinville, WA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/800,066

(22) Filed: Mar. 12, 2004

(65) Prior Publication Data

US 2004/0194974 A1 Oct. 7, 2004

Related U.S. Application Data

(62) Division of application No. 10/024,099, filed on Dec. 17, 2001, now Pat. No. 6,810,964.

(60) Provisional application No. 60/256,010, filed on Dec. 15, 2000.

(51) Int. Cl.
*A62C 11/00* (2006.01)
*A62C 35/02* (2006.01)
*A62C 35/58* (2006.01)

(52) U.S. Cl. ..... 169/30; 169/26; 169/28; 169/36; 169/85

(58) Field of Classification Search ..... 169/30, 169/71, 85, 43, 9, 88, 26, 84, 59; 239/309, 239/303

See application file for complete search history.

(56) References Cited

U.S. PATENT DOCUMENTS

| | | | | |
|---|---|---|---|---|
| 2,530,633 | A | 11/1950 | Scholz | 169/26 |
| 3,228,474 | A | 1/1966 | Huthsing, Jr. | 169/31 |
| 4,319,640 | A | 3/1982 | Brobeil | 169/28 |
| 4,998,751 | A | 3/1991 | Paxton et al. | 280/741 |
| 5,219,178 | A | 6/1993 | Kobari et al. | 280/736 |
| 5,224,550 | A | 7/1993 | Bragg | 169/62 |
| 5,564,743 | A | 10/1996 | Marchant | 280/741 |
| 5,697,636 | A | 12/1997 | Orme et al. | 280/728.2 |
| 5,709,406 | A | 1/1998 | Buchanan | 280/737 |
| 5,718,294 | A | 2/1998 | Billiard et al. | 169/61 |
| 5,816,330 | A | 10/1998 | Billiard et al. | 169/26 |
| 5,934,705 | A | 8/1999 | Siddiqui et al. | 280/736 |
| 5,967,550 | A | 10/1999 | Shirk et al. | 280/736 |
| 6,062,143 | A | 5/2000 | Grace et al. | 102/530 |
| 6,702,033 | B1 * | 3/2004 | Mitchell et al. | 169/85 |
| 6,810,964 | B1 * | 11/2004 | Arnot | 169/30 |

FOREIGN PATENT DOCUMENTS

| | | |
|---|---|---|
| WO | WO 00/57959 | 10/2000 |
| WO | WO 01/34516 | 5/2001 |

* cited by examiner

*Primary Examiner*—Davis Hwu
(74) *Attorney, Agent, or Firm*—Anthony P. Gangemi; Wiggin and Dana LLP

(57) ABSTRACT

A fire extinguisher includes a gas generator for pressurizing a suppressant. The generator includes an ignition cord within a flexible tube extending within an interior of an extinguisher bottle. Advantageously, there is additional generant between the tube and the ignition cord. The extinguisher may be manufactured as a retrofit of an existing hand-held supercharged extinguisher.

21 Claims, 6 Drawing Sheets

PRESSURIZATION SYSTEM FOR FIRE EXTINGUISHERS

CROSS-REFERENCE TO RELATED APPLICATION

This Patent Application is a divisional of U.S. patent application Ser. No. 10/024,099 entitled "PRESSURIZATION SYSTEM FOR FIRE EXTINGUISHERS," that was filed on Dec. 17, 2001 now U.S. Pat. No. 6,810,964 and relates to and claims priority to U.S. Provisional Patent Application Ser. No. 60/256,010 entitled "PRESSURIZATION SYSTEM FOR FIRE EXTINGUISHERS" . that was filed on Dec. 15, 2000. The disclosure of Provisional patent application Ser. No. 60/256,010, and patent application Ser. No. 10/024,099, are incorporated by reference in their entireties.

BACKGROUND OF THE INVENTION (1) Field of the Invention

This invention relates to fire extinguishers.

(2) Description of the Related Art

There are a wide variety of fire extinguishing technologies and fire extinguisher constructions. These include propellant-actuated extinguishers and extinguishers charged with compressed and/or liquefied gas. United States Military Specification MIL-E-52031D(ME)(5 Sep. 1979), the disclosure of which is incorporated by reference herein in its entirety, identifies a hand-held and actuated vaporizing-liquid fire extinguisher. This exemplary extinguisher utilizes $CF_3Br$ (monobromotrifluoromethane) suppressant.

U.S. Pat. No. 3,228,474 of Huthsing, Jr. discloses a portable extinguisher operated by puncturing a gas cartridge to pressurize the extinguisher.

The basic features of an early propellant-actuated extinguisher are seen in U.S. Pat. No. 2,530,633 (Scholz). Scholz discloses a fire extinguisher wherein "a liquid extinguishing medium, such as methyl bromide, is expelled from its container by gas evolved from the burning of" a pyrotechnic charge. The charge is originally stored in a container, which includes electric squibs. The charge container is mounted in an upper end of the vessel within a "container cup". Opposite the container cup, an outlet from the vessel is formed by an elbow fitting sealed by a rupturable diaphragm. Ignition of the pyrotechnic charge ruptures a lower wall of the charge container and vents combustion gases into the vessel. The combustion gases serve "as a gas piston acting on the surface of the liquid" rupturing the diaphragm which sealed the outlet and propelling the liquid out of the extinguisher.

The application of a propellant-actuated extinguisher to use in military vehicles is described in U.S. Pat. No. 4,319,640 (Brobeil). Brobeil discloses an extinguisher in many ways similar to Scholz. The exemplary fire suppressant utilized is Halon 1301. The lower end of the extinguisher vessel is sealed by a rupturable diaphragm. A gas generating device is mounted atop the neck of the vessel. The exemplary gas generating composition is 62% sodium azide and 38% copper oxide.

Patent Cooperation Treaty International Application PCT/US00/05953 (published as WO 00/57959) discloses a hybrid fire extinguisher.

Patent Cooperation Treaty International Application PCT/US00/30726 (published as WO 01/34516), the disclosure of which is incorporated by reference in its entirety herein, discloses a number of gas generation systems.

BRIEF DESCRIPTION OF THE INVENTION

One area of the invention involves the remanufacturing of a fire extinguisher. Advantageously, the remanufacturing may involve the conversion of a vaporizing-liquid extinguisher (preferably an expended one) to a propellant-actuated extinguisher. The cylinder or bottle is preferably reused as is the major portion of the discharge assembly. There may, advantageously, be a degree or cleaning or reconditioning of any reused components and assemblies. To the reused discharge assembly portion, there is added a portion including an elongate flexible gas generating component and means for igniting the component. The elongate flexible nature of the generator is advantageous to permit it to be inserted through the typically narrow opening in the bottle. Advantageously, the reused portion of the discharge assembly includes a lance previously utilized to puncture a seal to initiate discharge and, in the remanufactured condition, puncturing a seal and also actuating a firing pin to trigger a primer as the igniting means.

Other aspects of the invention involve the resulting fire extinguisher as well as fire extinguishers sharing construction details and operating parameters but not necessarily having been remanufactured from the previous conditions. In preferred implementations, the suppressant consists essentially or in major part of heptafluoropropane or a similar agent. The combustion gasses from the gas generator provide pressure and heat and diffuse into the suppressant and discharge the suppressant from the extinguisher. This combination may make the suppressant perform more similarly to a halon system than if the suppressant were merely squirted out under a cold supercharged mode (e.g., as if driven by a piston).

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION OF THE INVENTION

An exemplary pre-existing U.S. Army halon super-pressurized hand-held fire extinguisher has a pressure cylinder described in MIL-E-52031D as containing a supercharged agent at 380 psig at 68° F. The cylinder is 13.5 inches long, holding 2 pounds, 14 ounces of agent at maximum charge. Service rating for the cylinder is 500 psia having an internal volume of 80 cubic inches. A safety seal disk is set to burst at 1050 psia plus or minus 100 psia, thus protecting the cylinder from overpressure. The cylinder outlet port is well described in FIG. 1 of the MIL-E-52031 specification. The valving head, hose, swivel, handle lever, and safety pin are not defined in the specification except for operational test.

At one level, I have sought to reuse the existing cylinder of such an extinguisher. At another level, I have sought reuse or adapt additional components.

Figure 1:
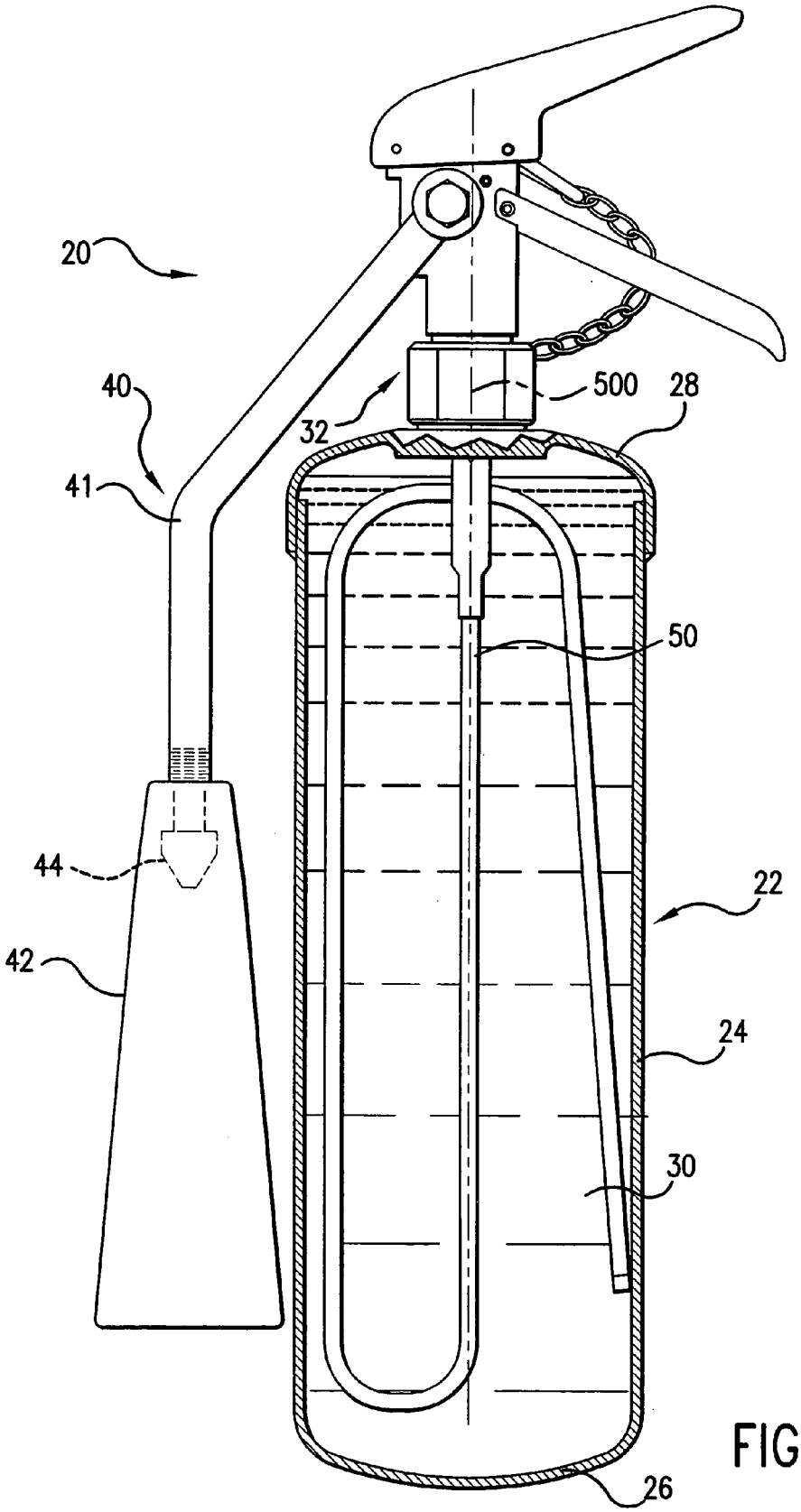
FIG. 1 is a longitudinal partial cross-sectional view of a fire extinguisher remanufactured according to principles of the invention.

FIG. 1 shows one example of a remanufactured extinguisher 20 comprising a rigid metal cylinder or bottle 22 having a central longitudinal axis 500. The exemplary cylinder is formed from a body piece having a generally cylindrical sidewall 24 and a unitarily formed first end 26. In the orientation shown, the first end is a lower end and an upper end portion 28 of the cylinder is sealed to the body such as via welding. The cylinder interior contains a charge of suppressant 30. Exemplary suppressants are a 2.5 pound. charge of NOVEC 1230™ (dodecafluoro-2-methylpentan-3-one), 3M Specialty Materials, St. Paul, Minn. or FM200 (heptafluoropropane), Great Lakes Chemical Corp., West Lafayette, Ind. A discharge head assembly 32 is mated to the cylinder at an outlet port formed in the upper end portion 28. The discharge head assembly is connected to a discharge conduit assembly 40 formed including an exemplary metal tube 41. Near the downstream end of the tube, there is secured a discharge horn formed as an exemplary frusto-conical sleeve 42. Inside the upstream end of the horn, a "v-shell" or foraminate mixing nozzle 44 may also be mated to the downstream end of the tube. Within the cylinder, an elongate gas generator assembly 50 depends within the cylinder and extends in a convoluted path to facilitate the assembly 50 having an extended length greater than any linear span of the cylinder interior. In combination, the gas generator assembly 50, discharge assembly 32, and the discharge conduit assembly 40 constitute a gas generator and discharge assembly.

The discharge head assembly includes a main body element 60 (FIG. 2) which may be machined from metal (e.g., brass) to which are mounted fixed and moveable handle portions 62 and 64, the latter of which is mounted for rotation about a transverse pivot axis 501. In a preferred use attitude of the exemplary embodiment, the fixed handle portion 62 is configured (e.g. shaped, dimensioned and positioned) to be gripped by the fingers of a user's hand while the moveable portion 64 is simultaneously engaged by the palm of the hand to allow the hand to apply a compressive force between the handle portions to shift the moveable handle portion toward the fixed handle portion from the relative position of FIG. 2. A lance 70 having upper and lower ends 72 and 74 is carried by the body element 60. An exemplary lance is machined from heat-treated alloy steel. An upper end portion of the lance extends through an aperture in the upper end of the main body element proximate the handle 64. The lance has a flange 76, the underside of which is supported against the upper end of a coil spring 80 encircling an intermediate portion of the lance within a compartment 82 of the element 60. The lower end of the spring rides atop the upper surface of a washer 91, itself atop the upper surface of a gasket 90 (e.g., an elastomer such as ethylene propylene or nitrile rubber). The washer and gasket combination is sandwiched between a lower shoulder of the compartment 82 and an upper rim of an end plug 94 (e.g., of corrosion-resistant steel) having an externally threaded neck engaged to an internally threaded lower end opening of the body element 60. The plug 94 is L-sectioned, having a lower shoulder flange at the base of the neck. A centrally apertured cap 100 (e.g., of cadmium plated steel) has an internally threaded lower portion mated to an externally threaded neck portion of the cylinder outlet port. Proximate the cap central aperture, an upper end flange of the cap compressively sandwiches the end plug's flange between itself and the outlet port rim via respective gaskets 110 (e.g., an elastomer such as ethylene propylene or nitrile rubber) and 112 (e.g., PTFE).

Figure 2:
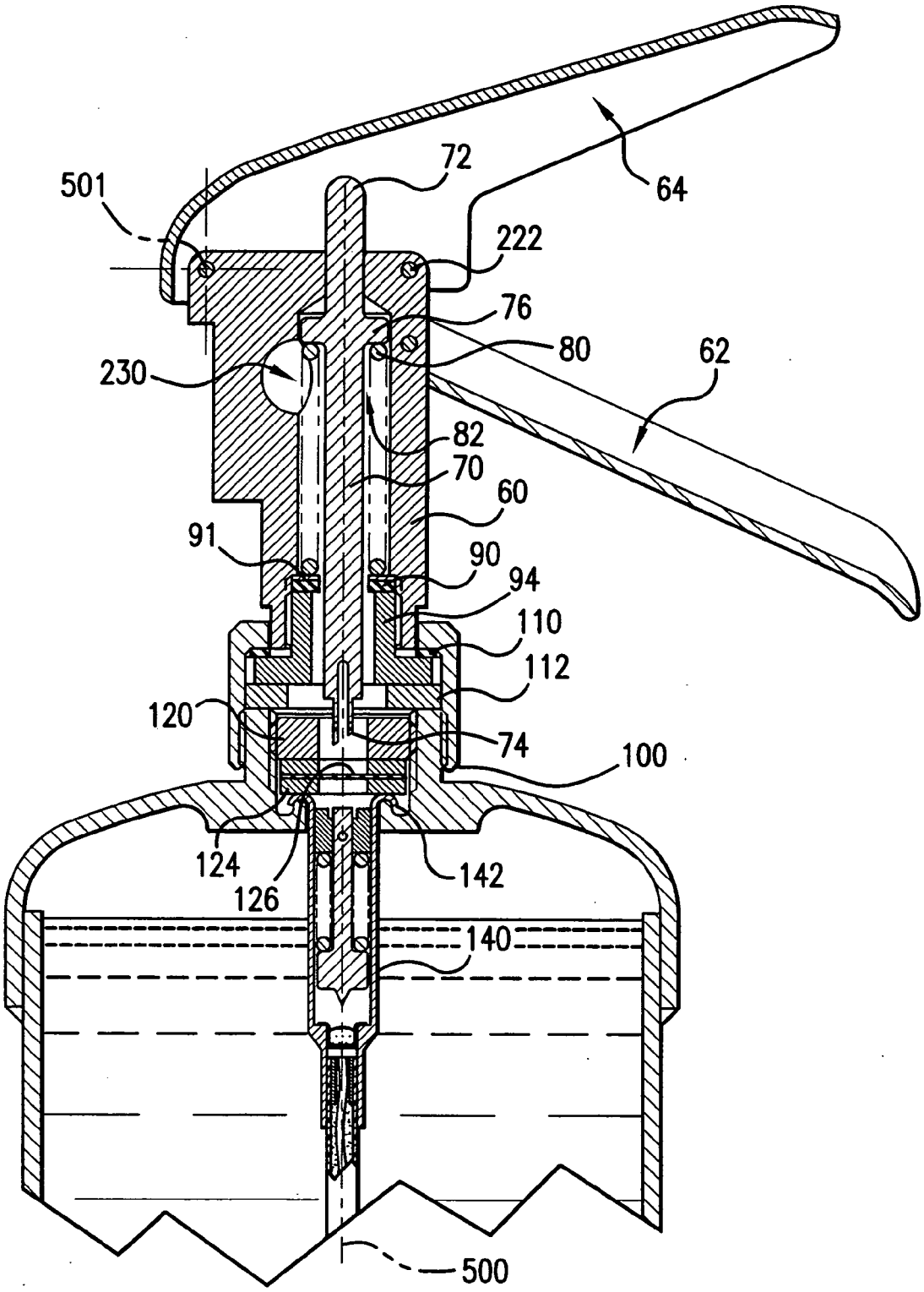
FIG. 2 is a longitudinal cross-sectional view of an upper portion of the fire extinguisher of FIG. 1.

The outlet port neck is additionally internally threaded to receive a corresponding centrally apertured, externally threaded end plug 120 (e.g., brass or bronze). Sandwiched below the end plug 120 is a seal assembly comprising a centrally apertured body 124 (e.g., of two copper disks) and a metallic sheet seal element 126 (e.g., a brass diaphragm soldered between the disks) extending across the aperture. The foregoing discharge head assembly components may advantageously be identical or similar to those of the underlying extinguisher being remanufactured. The dip tube assembly of the existing extinguisher may, however, be preferably replaced, modified, or augmented. FIG. 2 shows this having been replaced by an entirely new gas generator assembly 50. The assembly 50 includes a metal (e.g., machined brass) housing 140 having a flared upper end portion 142 sandwiched between the seal body 124 and an upwardly-directed lip at the base of the throat of the cylinder outlet in the cylinder upper end portion in a similar fashion as was secured a similarly-dimensioned portion of the replaced dip tube.

Figure 3:
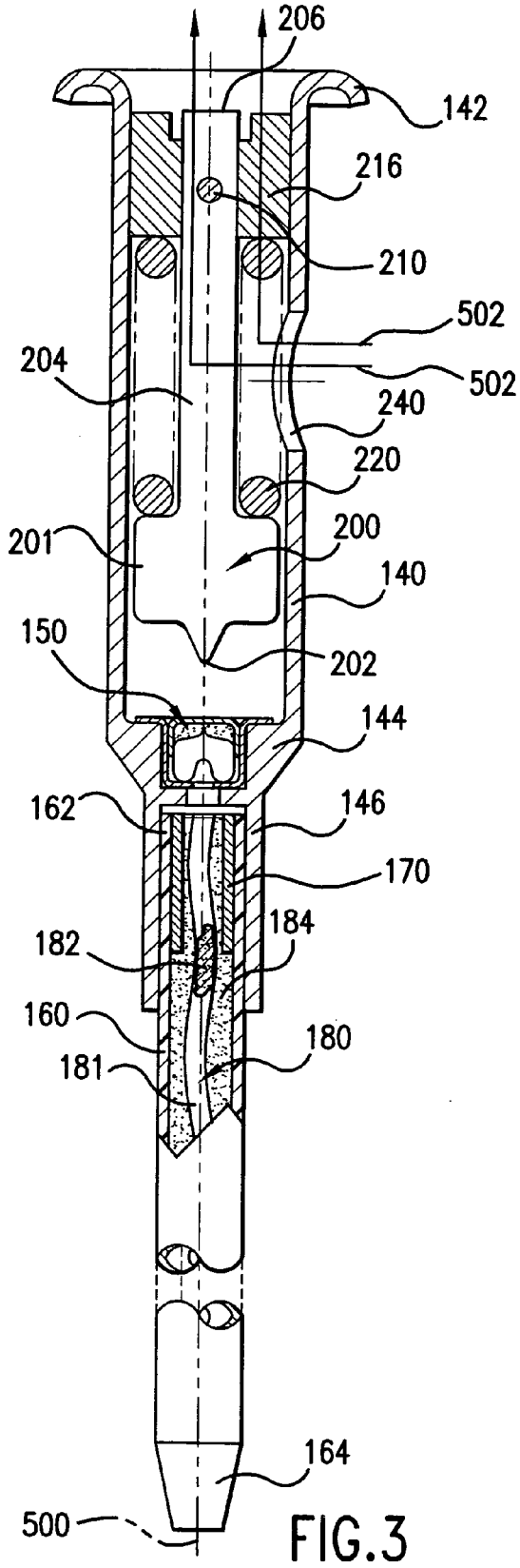
FIG. 3 is a longitudinal cross-sectional view of a firing pin housing and gas generator subassembly of the extinguisher of FIG. 1.
Figure 4:
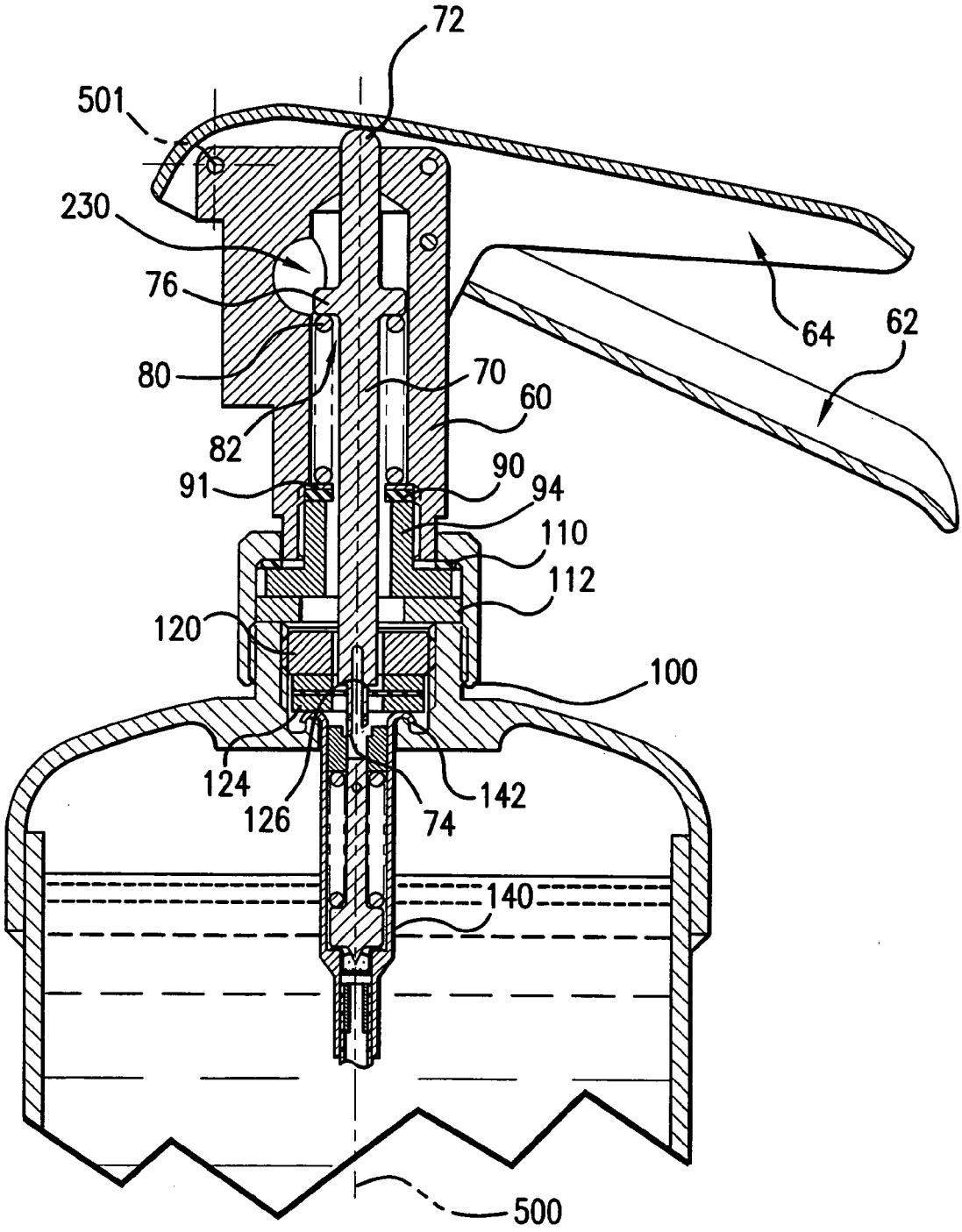
FIG. 4 is a longitudinal cross-sectional view of the upper portion of the extinguisher of FIG. 1 in a discharging condition

FIG. 3 shows further details of the exemplary generator assembly. The housing 140 has a generally cylindrical upper body portion depending from the end 142 to a shoulder 144. A neck 146 further depends from the shoulder. A percussion primer 150 (e.g., a conventional #209 shotshell primer) is carried within an upwardly open bore of the shoulder. At the bottom of the bore is a centrally apertured web defining a flash hole. Below the web and within the neck is the proximal end of a generant subassembly. The generant subassembly includes a flexible polymeric outer tube (e.g., TEFZEL™ ETFE of E.I. du Pont de Nemours & Co., Wilmington, Del.) 160 extending from an open proximal end 162 to a closed (e.g., crimped and/or heat-sealed) distal end 164. Within the neck 146, the outer surface of the tube 160 is crimped to contact with the neck inner surface. Within the tube 160 within the neck 146, a hollow tubular ferrule 170 (e.g., of mild or stainless steel) extends. With the neck crimped around the ferrule, the ferrule has an outer surface compressed against the tube inner surface to frictionally retain the adjacent end portion of the tube within the neck. Within the tube 160 and optionally within the ferrule 170 there extends an ignition cord element 180 (e.g., ITLX, having a flexible sheath 181 and a pyrotechnic charge 182 contained therein). This may extend for most if not substantially all of the length of the tube. A charge of an additional gas generant propellant 184 (e.g., a hybrid composite propellant such as ammonia nitrate phase stabilized with an oxidizer (e.g., potassium perchlorate)) may be disposed in the annulus between the ignition cord 180 and the tube 160. The primer 150 is positioned in sufficient proximity to the upper end of the ignition cord (or any intervening transfer charge) so that ignition of the primer 150 may, through the flash hole, in turn induce ignition of the cord 180.

To trigger the primer 150, a firing pin 200 is provided within the body 140. The exemplary firing pin is advantageously formed of metal (e.g. turned from heat-treated alloy steel). The firing pin has a head 201 having a lower striker tip 202. A stem 204 extends upward from the head to an upper end 206. Adjacent the upper end, the firing pin is initially held in a first, elevated, position via a shear pin 210 extending transversely through an aperture in the stem 204 and, at its ends, embedded in a plug 216 force fit within an upper end portion of the housing 140. The plug 216 has a cruciform cross section transverse to the axis 500 to create four longitudinal passageways parallel to the axis. A coil spring 220 is compressed between the lower end of the plug 216 and the underside of the firing pin head to bias the head downward.

In operation, the user removes the safety pin 222 and grips the handles 64 and 62 to draw the two together. This depresses the handle 64 causing it to pivot downward until an underside of its interior contacts the upper end 72 of the lance 70. Further actuation drives the lance downward, compressing the spring 80. The lower end of the lance first punctures the seal 126 and then contacts the upper end of the firing pin. The force exerted on the firing pin is sufficient to shear the pin 210 whereupon relaxation of the spring 220 drives the firing pin downward until its tip 202 impacts the primer 150 and sets off the primer, in turn setting off the ignition cord 180 and the additional generant (if any) 184. The generated gas rapidly charges the extinguisher and raises the pressure within the cylinder. The elevated pressure drives the suppressant through apertures 240 in the generator housing. The suppressant may thus flow along a discharge path 502 into the interior of the housing 140 from which it progresses further upward around the firing pin through vertical passageways between the arms of the end plug 216 to the interior of the head element 60 and therefrom through a discharge plenum 230, the discharge conduit and out the nozzle/horn.

Figure 5:
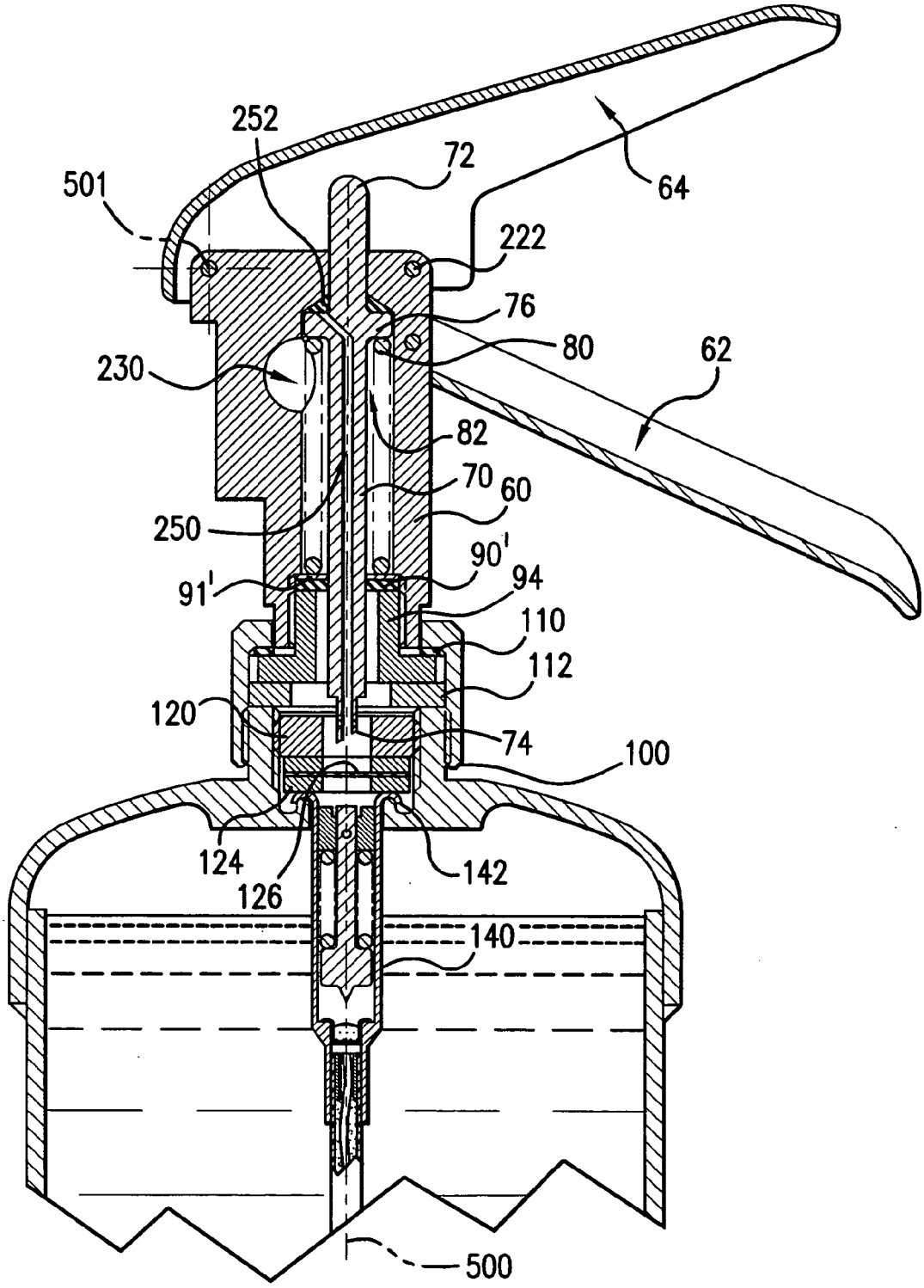
FIG. 5 is a longitudinal cross-sectional view of an alternate fire extinguisher upper portion.
Figure 6:
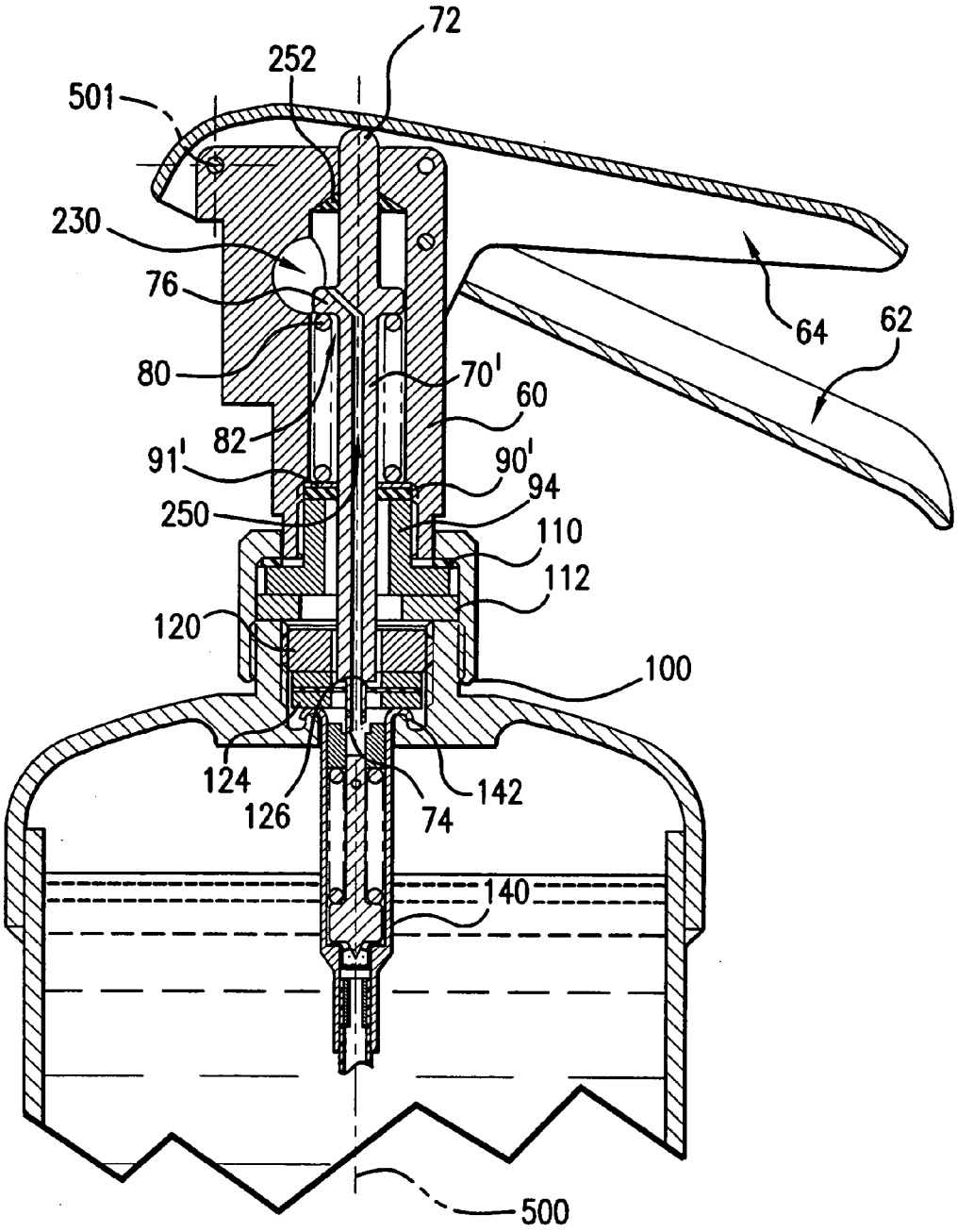
FIG. 6 is a longitudinal cross-sectional view of the upper portion of the alternate extinguisher in a discharging condition.

FIGS. 5 and 6 show an alternate extinguisher construction in which the lance 70' has been further modified for additional valving functionality. An inner cylindrical surface of the gasket 90' (backed-up by washer 91') is in sealing engagement with the outer cylindrical surface of the lance below the flange. A channel 250 extends centrally upward from its lower end 74 and exits at the upper surface of the flange 76. A seal 252 (e.g., an elastomeric grommet) is in sealing engagement with the outer cylindrical surface of the lance above the flange. In an initial elevated position, the upper surface of the lance is held engaged to the lower surface of the grommet 252 via the spring 80. Upon actuation and ignition, engagement of the seal 90' with the lance, combined with presence of the channel 250 diverts the exiting suppressant along a discharge path through the channel 250 to the discharge plenum 230 (FIG. 6). During discharge, the handle portion 64 may be released whereupon the spring 80 will return the lance to its elevated position. In the elevated position, the grommet 252 seals the upper end of the channel 250 resisting further discharge. This leaves the extinguisher in an at least temporarily supercharged condition. The handle portion 64 may then again be pivoted downward, disengaging the flange upper surface from the grommet 252 and reestablishing a full discharge flow. In the at least temporarily supercharged condition, there may well be some minor leakage. Such leakage may be desirable to prevent over pressurization as it may merely be desired to allow the user to temporarily (e.g., for a few seconds) interrupt flow so as to allow the user to make an efficient use of the available suppressant in extinguishing a fire. The leakage may be through the channel 250 or may be between the gasket 90' and the lance or may be via other means such as an additional pressure relief valve (not shown).

An exemplary pressure relief valve (not shown) may be incorporated into the sidewall of the valve body element 60 adjacent to the spring 80 in the compartment 82. An exemplary cracking pressure for such valve is in the 400–450 psi range. The valve acts to safe the bottle in the event, for example, the unit is exposed in a fire causing the suppressant to boil or resulting from an auto-ignition event.

Although key uses are in military vehicles (e.g., land vehicles and aircraft) the extinguishers may also be useful in buildings with high value electronics, commercial aircraft, commercial marine, and other specialty applications. Although the extinguishers are advantageously constructed by rebuilding existing vaporizing-liquid fire extinguishers (especially discharged extinguishers) the present teachings are, to varying degrees, applicable to entirely new construction. When expended, the present extinguishers may potentially be themselves remanufactured.

Among possible variations in extinguisher construction are:

a duplex fire extinguisher utilizing a double bottle allowing two independent pressurizing/discharging events;

use of alternate discharge conduit assemblies (e.g., including alternate nozzles, etc.);

use of the ignition components in other than hand-held extinguishers;

use of a hand lever-actuated, trip-sear, hammer striker and firing pin to trigger the percussion primer (e.g., as in rifle bolt strikers);

use of a delivery valve that remains locked until a threshold pressure (e.g., 400 psi) is achieved within the cylinder (e.g., via a pressure-actuated piston or diaphragm which will lock and unlock the valve poppet);

use of a hand lever-actuated, fixed-rate delivery rate, o-ring sealed lever-lift, pintle valve (to the extent that the valve does not seal the suppressant prior to use, a precision seat and seal set are not required);

use of an initiator or squib as the igniting means in place of the percussion primer so as to provide a more automated initiation (e.g., a fully automatic electrical operation initiated responsive to heat sensors to protect the crew if they are unable to actuate the extinguisher manually); and/or a visible and tactile indicator on the valve cap allowing rapid determination of the operational status.

Among alternative suppressants are:

low vapor pressure fluorocarbons such as:

methoxy-nonafluorobutane;

dodecafluoro-2-methylpentan-3-one;

perfluorohexane; and perfluoroheptane; and aqueous solutions, including those containing additives such as:

ammonium or potassium phosphate salts;

potassium salts such as those containing phosphate, acetate, bicarbonate, carbonate, bromide, iodide; and/or various surfactants.

One or more embodiments of the present invention have been described. Nevertheless, it will be understood that various modifications may be made without departing from the spirit and scope of the invention. For example, many of the features of the illustrated embodiments may be recombined to produce other embodiments or may be adapted for use with a variety of existing or future extinguisher constructions, suppressants, propellants, and the like. Accordingly, other embodiments are within the scope of the following claims.

What is claimed is:

1. A method for remanufacturing a discharged vaporizing-liquid fire extinguisher comprising:

removing a first discharge assembly from an extinguisher bottle;

removing a dip tube from the bottle;

cleaning the bottle;

filling the bottle with a liquid suppressant;

inserting a gas generator into the bottle; and either reinstalling the first discharge assembly or installing a second discharge assembly.

2. The method of claim 1 wherein:

the removal of the dip tube is simultaneous with or subsequent to the removal of the first discharge assembly;

the insertion of the gas generator comprises positioning the gas generator so as to replace the dip tube or an assembly, which had included the dip tube;

the step of filling the bottle with a liquid suppressant comprises filling the bottle with a liquid having a vapor pressure of less than 100 psi at 21° C.; and the gas generator is inserted after the bottle is filled.

3. The method of claim 1 wherein the second discharge assembly is a reconditioned discharge assembly from a substantially identical vaporizing-liquid fire extinguisher.

4. The method of claim 1 wherein the step of inserting a gas generator comprises feeding an elongate flexible gas generant-containing member into the bottle, the member having a length longer than a length of the bottle so as to place the member in a convoluted condition within the bottle.

5. The method of claim 1 wherein the liquid suppressant is selected from the group consisting of dodecafluro-2-methylpentan-2-one, heptafluropropane, methoxy-nonafluorobutane, perfluorohexane and fluoroheptane.

6. The method of claim 1 wherein the liquid suppressant is an aqueous solution comprising an additive.

7. The method of claim 6 wherein the additive comprises ammonium phosphate salts, potassium phosphate salts, potassium acetate, potassium bicarbonate, potassium carbonate, potassium bromide, potassium iodide, surfactants, or any combinations thereof.

8. The method of claim 1 wherein the gas generator and discharge assembly is selected to include a rigid metallic firing pin housing comprising:

a distal end portion containing proximal end portions of an ignition cord and flexible tube;

an intermediate portion holding the primer in press fit relation;

a proximal portion at least partially containing the firing pin; and wherein a discharge path for the suppressant extends through at least one lateral aperture in the firing pin housing and therefrom, through a proximal end of the firing pin housing.

9. A method of manufacturing a fire extinguisher fire extinguisher comprising:

providing a bottle having an interior and at least an outlet;

introducing a fire suppressant into the bottle when the extinguisher is in a pre-discharge condition; and securing and extending though a gas generant and discharge assembly to the bottle outlet;

wherein the gas generant and discharge assembly comprises:

a source of gas for pressurizing the suppressant at least when the bottle is in a discharging condition comprising:

an ignition cord having a sheath and a pyrotechnic charge contained within the sheath and extending from a proximal end to a distal end;

a flexible tube surrounding the sheath at least along a major portion of a length thereof and extending from a proximal end to a distal end;

a gas generant charge contained between the tube and sheath; and means for igniting the ignition cord; and an outlet, through which the suppressant is discharged when the extinguisher is in the discharging condition.

10. The method of claim 9 wherein:

the means for igniting is selected to include a percussion primer having a primer charge and an operative end in close facing relationship to the proximal end of the ignition cord effective to ignite the ignition cord;

the gas generator and discharge assembly comprises:

a first handle portion positioned to be gripped by the fingers of a user's hand and a second handle portion positioned to be simultaneously engaged by a palm of said hand and mounted to be shifted toward the first handle portion responsive to a compressive force applied by the hand;

firing pin mechanism mounted for spring-biased movement between an initial position and second position in which an operative end portion of the firing pin mechanism contacts the percussion primer with effective momentum to trigger the primer.

11. The method of claim 10 wherein:

the firing pin mechanism is selected to include:

a spring-loaded firing pin initially held in its initial position by a sacrificial element against the spring-bias force; and a lance shiftable between its initial position and its second position by said movement of the second handle portion, the shift of the lance rupturing the sacrificial element to release the firing pin.

12. The method of claim 11 further including a seal, initially between the lance and the firing pin and initially sealing the bottle interior from an external environment and mounted so as to be ruptured by the shift of the lance.

13. The method of claim 12 wherein the gas generator and discharge assembly further including a rigid metallic firing pin housing comprising:

a distal end portion containing proximal end portions of the ignition cord and flexible tube:

an intermediate portion holding the primer in press fit relation; and a proximal portion at least partially containing the firing pin; and wherein a discharge path for the suppressant extends through at least one lateral aperture in the firing pin housing and, therefrom, through a proximal end of the firing pin housing.

14. The method of claim 13 wherein in the pre-discharge condition the pressure within the bottle is lower than 70 psi and the ignition cord pyrotechnic charge and the gas generant charge are, in combination, effective to at least temporarily elevate the pressure within the bottle to between 300 and 450 psi.

15. The method of claim 9 wherein the suppressant consists in major mass part of heptafluropropane, and has a total mass of less than 7 pounds.

16. The method of claim 15 wherein the total mass is 2–3 pounds.

17. The method of claim 15 wherein a minimum bottle diameter between the interior and the outlet is no more than 0.5 inch.

18. The method of claim 17 wherein the ignition cord has a length of between 1 and 3 feet.

19. The method of claim 9 wherein the ignition cord has a length of at least one foot.

20. The method of claim 9 wherein the suppressant comprises 2–3 pounds of dodecafluoro-2-methylpentan-3-one.

21. The method of claim 9 wherein the suppressant consists essentially of at least one fluorocarbon.

* * * * *